United States Patent [19]

Wieja et al.

[11] Patent Number: 4,932,833

[45] Date of Patent: Jun. 12, 1990

[54] RING CHANNEL BLOWER

[75] Inventors: Peter Wieja, Augsburg; Georg Baechle, Germering, both of Fed. Rep. of Germany

[73] Assignee: Webasto AG Fahrzeugtechnik, Stockdorf, Fed. Rep. of Germany

[21] Appl. No.: 318,770

[22] Filed: Mar. 3, 1989

[30] Foreign Application Priority Data

Mar. 6, 1988 [DE] Fed. Rep. of Germany ..... 3807362
Jul. 1, 1988 [DE] Fed. Rep. of Germany ..... 3822267

[51] Int. Cl.[5] ..... F04D 5/00
[52] U.S. Cl. ..... 415/58.1; 415/58.4
[58] Field of Search ..... 415/55.1, 55.4, 52.1, 415/58.4, 145, 144, 148

[56] References Cited

U.S. PATENT DOCUMENTS

| | | | |
|---|---|---|---|
| 3,356,033 | 12/1967 | Ullery | 415/55.4 |
| 3,989,411 | 11/1976 | Middleton | 415/55.4 |
| 4,408,952 | 10/1983 | Schweinfurter | 415/55.1 |
| 4,412,781 | 11/1983 | Abe et al. | 415/55.4 |
| 4,439,095 | 3/1984 | Galtz et al. | 415/58.4 |

FOREIGN PATENT DOCUMENTS

| | | |
|---|---|---|
| 6604782 | 2/1970 | Fed. Rep. of Germany . |
| 2531740 | 2/1977 | Fed. Rep. of Germany . |

*Primary Examiner*—Carl D. Price

*Assistant Examiner*—John T. Kwon

*Attorney, Agent, or Firm*—Sixbey, Friedman, Leedom & Ferguson

[57] ABSTRACT

A ring channel blower for combustion air conveyance in heaters, preferably motor vehicle heaters. With this ring channel blower, there is a gradual transition from the pressure area to the discharge opening of a ring channel that is covered at a side of the ring channel proximate an impeller by an upstream extending section of a cross piece-shaped interrupter. Suitably, a sickle-shaped or sail-shaped section covering the ring channel is provided which, starting from the inner edge of the ring channel, approximately at the height of the projection of the discharge opening on the ring channel, uniformly tapers in a direction opposite the compression direction in the ring channel of the ring channel blower and ends in a type of rounded tip on the outer edge of the ring channel of the ring channel blower. Further, a section of the interrupter is provided at the inlet area that partially covers the inlet opening and which, starting from the outer edge of the ring channel, extends approximately tangentially to the inner edge of the ring channel. This section is simultaneously inclined slightly toward the base of the ring channel. A bypass between the discharge opening and the inlet opening can be provided in the form of an elongated slot in a partition portion of the interrupter, the free opening cross section of which is adjustable via a setscrew.

20 Claims, 3 Drawing Sheets

FIG. 3
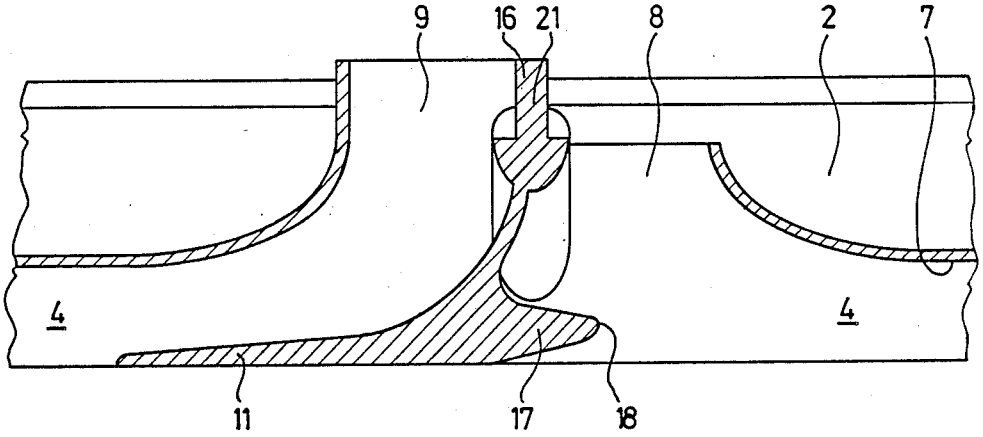
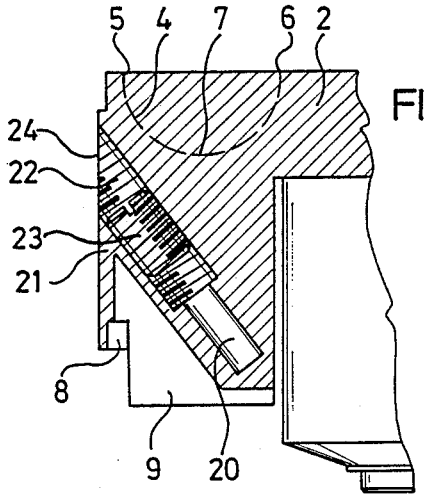
FIG. 4

RING CHANNEL BLOWER

BACKGROUND OF THE INVENTION

The invention relates, in general, to a ring channel blower, also known as a side channel or lateral duct blower, that is intended, in particular, for combustion air conveyance in heaters, such as motor vehicle heaters. More specifically, the invention relates to a ring channel blower of the type wherein an impeller edged with vanes rotates opposite a ring channel that is formed in a housing part of the ring channel blower with an inlet opening, a discharge opening, and a cross piece-shaped interrupter lying between them, as well as, in some cases, a bypass channel which can be adjusted by a setscrew for output regulation.

In U.S. Pat. No. 4,439,095, a ring channel blower is described, wherein output regulation is achieved by a bypass channel, that is formed in a partition wall provided between the inlet opening and discharge opening of the channel, the cross section of which can be adjusted by a screwing in or out of a setscrew.

From German Offenlegungsschrift No. 25 31 740 and German Gebrauchsmuster No. 66 04 782, ring channel blowers of the type mentioned above are known in which a section of the cross piece-shaped interrupter extends upstream from the discharge opening and covers the ring channel at a side of the channel in proximity to the impeller. Ring channel blowers of standard construction operate relatively noisily, which is increasingly felt to be inconvenient when, corresponding to current efforts by motor vehicle producers, the passenger compartment is becoming less noisy due to soundproofing. In particular, with the use of such ring channel blowers in a motor vehicle heater, the operation of the heater can be perceived in the passenger compartment of the motor vehicle.

SUMMARY OF THE INVENTION

Thus, a primary object of the invention is to provide a ring channel blower of the type described above whose noise emission is extensively reduced.

According to a preferred embodiment of the invention, such a ring channel blower, in particular for combustion air conveyance in heaters, such as motor vehicle heaters of the type having a ring channel in a housing part that has an inlet opening and a discharge opening as well as a cross piece-shaped interrupter lying between them, and with an impeller edged with vanes facing the ring channel, is designed to produce a gradual transition from the pressure area to the discharge opening, the ring channel covering/section of the interrupter, that covers the ring channel proximity to the impeller, tapers uniformly going from the inner edge of the ring channel in the area of the discharge opening in a direction toward the outer edge of the ring channel.

In contrast to previous ring channel blowers, in which there is an abrupt transition from the pressure area to the discharge opening of the ring channel blower, by which whistling noises arise during operation of the ring channel blower, the ring channel blower according to the invention is made so that the ring channel is covered in a gradually increasing manner on its side in proximity to the impeller. By virtue of this design according to the invention, it has been surprisingly shown that the noise level of such a ring channel blower can be greatly reduced during operation since the gradual transition results in no sudden pressure surges arising that can cause whistling because of an abrupt transition from the ring channel to the discharge opening, but rather that the air conveyed in the ring channel travels gradually toward the discharge opening and the air pressure is gradually evened out until discharge. Another benefit that results from the invention is that intake mufflers, which were previously needed, can be eliminated. In this way, the ring channel blower according to the invention makes possible an extremely quiet operation with minimal noise emission, so that in the passenger compartment of a motor vehicle, the operation of the ring channel blower, in the case of a motor vehicle heater, can hardly be perceived anymore, yet it is possible to avoid expensive muffling measures in such motor vehicle heaters.

To avoid, as much as possible, turbulence forming sharp edges in the flow area of the air in the ring channel, the ends of the interrupter section covering the ring channel that merge with the inner edge and/or outer edge of the ring channel are made spiral-shaped.

In a preferred embodiment according to the invention, the ring channel covering/section at the discharge side is sickle-shaped or sail-shaped and its tip ends at the outer edge of the ring channel and points opposite the compression direction. By this design, the pressure differences between the inner edge and the outer edge of the ring channel are gradually reduced until discharge without having to put up with losses in the performance of the ring channel blower.

To extensively minimize inner flow resistances, especially in the inlet area of such a ring channel blower, a part of the cross piece-shaped interrupter of the ring channel blower is inclined at the inlet area in the direction of the bottom of the ring channel, is provided with a rounded end edge and at least partially covers the inlet opening. This achieves a tangential inflow of the medium to be compressed, such as air, into the ring channel at the inlet area, so that a quiet inflow, for example of the air to be compressed in the ring channel blower and to be conveyed by it, can be guaranteed.

To optimize the ring channel blower from a flow engineering viewpoint, the ring channel, itself, can be contoured to promote flow, at least in the inlet area, so that, seen in the inflow direction, there is a gradual transition from the inlet opening to the bottom of the ring channel. This reduces the flow resistance in the inlet area of the ring channel blower to improve the efficiency of the ring channel blower itself.

According to another advantageous feature according to the invention, for further optimization from a flow engineering viewpoint, the ring channel is also contoured to promote flow in the area of the discharge so that, seen in the flow direction, there is a gradual transition from the bottom of the ring channel to the discharge opening. This also reduces the flow resistance in the discharge area of the ring channel blower for further improvement of the overall efficiency of the ring channel blower. These gradual transitions are suitably formed from curves in the transition area or so-called transition radii, and the term "transition radii" is to be understood not only in 2 dimensions but also in 3 dimensions, relative to the form of the ring channel.

Preferably the section covering the ring channel has a boundary curve whose curvature is between 3R and $R-r/2$, where R designates the outer edge of the ring channel and r the radius of the inner edge of the ring channel, i.e., R-r designates the width of the ring channel. Within this size range, the course of the section covering the ring channel can be selected extensively in any way and curves of this area can be combined with each other in any way. Projected on approximately the middle of the discharge opening, the section covering the ring channel, thus, extends maximally approximately over a sector 80° as seen in a direction opposite the compression direction of the ring channel blower. Depending on the width of the ring channel, according to the definition above, modified, curved boundary lines can also be determined in which, for example, two or more different curvature radii are combined.

To achieve as favorable as possible a characteristic curve relative to the total pressure difference and the volume flow in the ring channel blower according to the invention, and in particular not to have to put up with performance losses, but rather to obtain a more favorable course of the characteristic curve of such a ring channel blower, a gradual transition that is contoured to promote flow extends from the inlet opening to the bottom of the ring channel and/or from the bottom of the ring channel to the discharge opening, in each case, over an area of at most 20% of the length of the ring channel. This assures that a sufficient length of the ring channel is available for the compression operation to be performed in the ring channel blower and for the conveying operation.

Further, the noise emission in the ring channel blower can surprisingly still be reduced in that the bypass channel is provided in a partition that runs approximately perpendicular to the ring channel plane and extends between the inner edge and outer edge of the ring channel between the inlet opening and the outlet opening. This bypass channel is, thus, not provided in the peripheral surface near the bottom of the ring channel since, namely at this point, an abrupt transition would result when the bypass channel is open, but rather it is placed, in the ring channel blower according to the invention, in the area of the discharge opening and produces a connection between discharge and inlet openings that lies as close as possible to the mouth of the discharge opening. Thus, at this point, the air flow has already been evened out and calmed, so that whistling noises can also be avoided at this point.

Preferably, the bypass channel is made as an elongated, slot-shaped opening in the partition, so that it can be produced in a simple way during manufacturing. With such a slot-shaped opening, the opening cross section desired in each case can also be adjusted to a relatively wide path.

To also obtain a gradual transition from the discharge area to the inlet area in the area of the bypass channel, the bypass channel is placed in the partition so as to be inclined relative to the outer edge of the ring channel in the direction of the discharge opening. Generally speaking, it can be said that this bypass channel points diagonally toward the middle of the housing part containing the ring channel. Preferably, the bypass channel encloses an acute angle relative to the outer edge of the ring channel. This acute angle, suitably, lies in a range of about 20° to about 45°, and, preferably, it is about 38°. These angles of inclination have proven to be suitable based on tests.

In the preferred embodiment according to the invention, a setscrew is used to adjust the opening cross section of the bypass channel and is also placed so as to be inclined relative to the outer wall of the housing part containing the ring channel, i.e., the thread to adjust the setscrew is cut into the housing part in the direction of extension of the center axis of the elongated, slot-shaped opening in the partition. Thus, even when the bypass channel is widely opened, no sharp edges appear in the area of the bypass channel, since the threads for adjusting the setscrew lie in the turbulent region of the air flow in the area of the bypass channel. Preferably, the angle of inclination of the setscrew lies in about the same range as the acute angle of the bypass channel, so that the angle of inclination lies in a range of about 20° to about 45° and, preferably, the angle of inclination is about 38°.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWINGS

FIG. 3 is a sectional projection taken along line III—III in FIG. 2;

FIG. 4 is a sectional view taken along the IV—IV in FIG. 1; and

Throughout the Figures of the drawing, the same or similar parts are provided with the same reference symbols.

DETAILED DESCRIPTION OF THE PREFERRED EMBODIMENT

Figure 1:
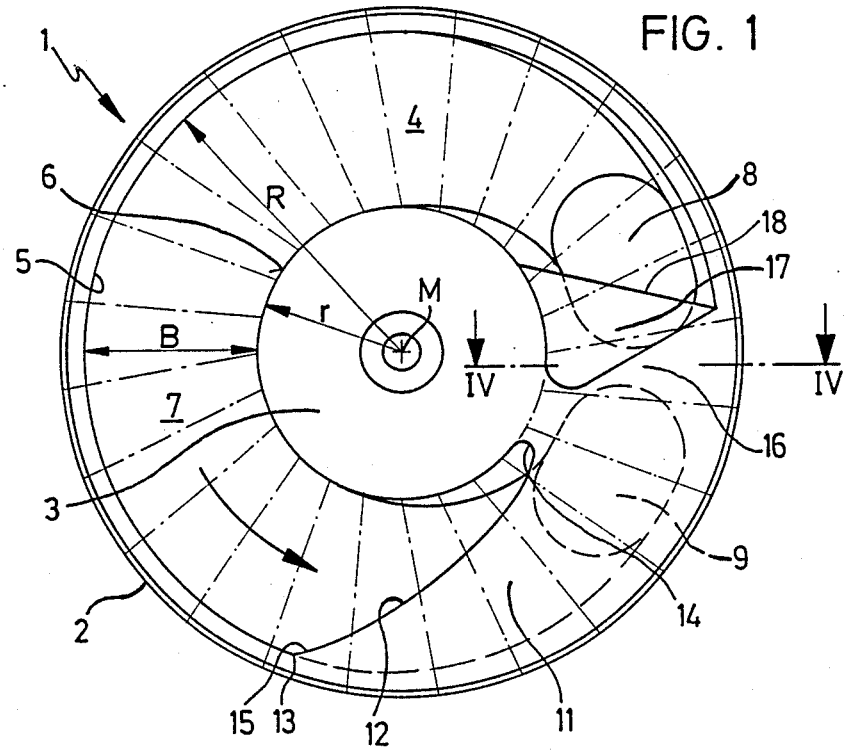
FIG. 1 is a bottom plan view of the housing part of the ring channel blower, and, for reasons of clarity, its impeller edged with vanes is indicated only diagrammatically with dashed lines.

The ring channel blower, as a whole, is designated by numeral 1 and has a housing part 2 and an impeller 3 edged with vanes, which is indicated by dashed lines in FIG. 1. Impeller 3 is rotationally driven by a motor, for example an electrical motor, that is merely diagrammatically represented. In housing part 2, a ring channel 4 is formed that has an approximately semicircular-shaped cross section. This semicircular-shaped cross section extends from an outer edge 5 over a deepest point of ring channel 4, i.e., a so-called bottom 7 of ring channel 4, to an inner edge 6 which, seen in the axial direction of housing part 2, lies about at the same height as outer edge 5. Measured from a middle point M of housing part 2 (corresponding to the center of the motor shaft), the outer edge 5 of ring channel 4 has a radius R and the inner edge 6 has a radius r. As shown in FIG. 1, the width of the ring channel B equals the difference between radius R of outer edge 5 and radius r of inner edge 6 and is, thus, represented by the relationship: $B=R-r$. In the plan view shown in FIG. 1, numeral 8 designates an inlet opening of the ring channel blower 1, and 9 its discharge opening. In FIG. 1, discharge opening 9 is shown in dashed lines. Inlet opening 8 and discharge opening 9 point about in the same direction, namely in the direction of the exterior side of housing part 2, as can be seen from FIG. 2. Fresh air, for example combustion air, enters from the surroundings via an air inlet casing not represented in detail.

The compression direction is shown by a counterclockwise directed arrow in FIG. 1. Ring channel 4 is covered by a section 11 of a cross piece-shaped interrupter 16, at a side of channel 4 that is in proximity to the impeller 3. Section 11 extends from the area of discharge opening 9 in an upstream direction, i.e., in a direction opposite the compression direction. In the embodiment represented, upstream directed interrupter section 11 is sickle-shaped or sail-shaped and has a boundary edge 12 that curves outwardly from inner edge 6 of ring channel 4 so as to end in a kind of tip 13, on outer edge 5 of ring channel 4. Thus, section 11 of the interrupter 16 tapers uniformly from inner edge 6 to outer edge 5 of ring channel 4. The curved boundary edge 12 is not sharp-edged but is slightly beveled or rounded, instead. The transition 14, between section 11 and inner edge 6, is advantageously also rounded, and can be made spiral-shaped, i.e., when the curved shape shown in FIG. 1 is viewed in three dimensions. The transition 15, between section 11 and outer edge 5, is also advantageously made suitably rounded or spiral-shaped.

Measured starting from about the middle of discharge opening 9 this sail-shaped interrupter section 11 covering the ring channel 4 extends approximately over a sector of 80°. The curved boundary edge 12 represented is, naturally, to be understood as representing only an example and, depending on the dimensions of ring channel 4, it can have a curvature between 3R and $(R-r)/2$. Thus, the radii of curvature can be selected in the range of triple the radius R of outer edge 5, starting as a maximum value, to the minimal value, which equals about one-half of the width B of ring channel 4.

The cross piece-shaped interrupter 16 separates inlet opening 8 from discharge opening 9, and vice versa. The cross piece-shaped interrupter 16 is formed in ring channel blower 1 so that, at the inlet area, a section 17 is obtained whose boundary edge 18 is made approximately tangent to the circle of inner edge 6. This section 17 is additionally inclined, relative to the plane extending between outer edge 5 and inner edge 6 of ring channel 4, in the direction of the bottom 7 of the ring channel 4. This inclination is only slight and can, for example, be about 12°. Section 17 partially covers the projection of inlet opening 8 on ring channel 4, so that the air flow entering the channel via inlet opening 8 is deflected so that it enters ring channel 4 tangentially.

As can be further seen from the projection according to FIG. 3, in the discharge area, there are essentially no sharp transition edges between discharge opening 9 and ring channel 4. Rather, the transition are rounded with the aid of transition radii. In connection with ring channel covering section 11 covering the discharge area of ring channel a configuration is used that results in the channel cross section gradually widening with rounded transitions from ring channel 4, toward discharge opening 9. In a similar way, it can be seen from FIG. 3 that the inlet area, starting from inlet opening 8, gradually narrows in cross section toward ring channel 4, and section 17 of cross piece-shaped interrupter 16 is configured in a corresponding way at the inlet area, so that the inlet area as well as the discharge area of ring channel blower 1 are contoured, seen overall, to promote flow, i.e., so that projecting sharp edges are not present in the air flow path. At all deflection areas there are gradual transitions, i.e., rounded or provided with radii of curvature, by which the flow resistance in the inlet area as well as in the discharge area is effectively reduced, and by which noise emissions, such as whistling noises, which previously led to loud operation of such a ring channel blower 1, are avoided especially effectively.

As can be taken especially from the projection according to FIG. 3, the discharge opening 9 has a larger axial length than the inlet opening 8. Thus, seen in the axial direction of housing part 2, the discharge opening 9 projects above the inlet opening 8. Naturally this does not have to be necessarily so, but this embodiment depends essentially on the design of the burner to be supplied with combustion air by ring channel blower 1 as well as on the space available for installation.

Essential in the design of ring channel blower 1 according to the invention is, thus, the fact that ring channel 4, at least in the area of the inlet opening 8 and, optionally, also in the area of the discharge opening 9, is contoured to promote flow so that a gradual transition in the inflow direction or outflow direction results from the inlet to the bottom 7 of the ring channel 4 or from the bottom 7 of the ring channel 4 to discharge opening 9, respectively. These partial sections of ring channel 4, being contoured to promote flow and forming a gradual transition, at which the ring channel 4 does not yet have its maximal channel cross section, extend preferably in each case over a range of at most 20% of the length of ring channel 4. Thus, a sufficient length of ring channel 4 is still present for compression and conveyance of the air.

Figure 2:
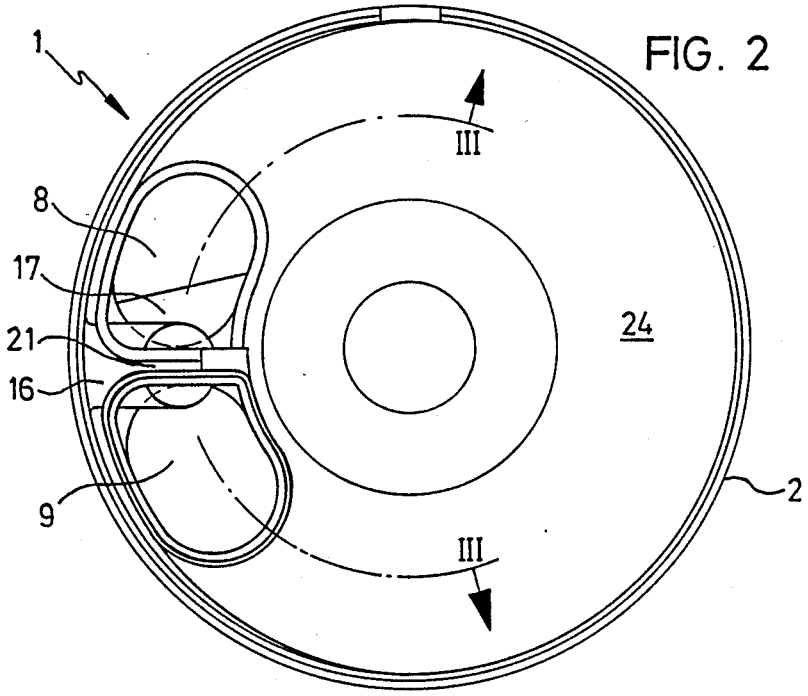
FIG. 2 is a top plan view of the outer side of the housing part, i.e., of its inlet and discharge area.

Based on FIGS. 2 and 4, the arrangement of a bypass channel 20 in ring channel blower 1 according to the invention will be described in more detail below. Bypass channel 20 is made in a partition 21 that runs approximately in the axial direction of the housing part 2 as an extension of cross piece-shaped interrupter 16. Thus, partition 21 runs approximately perpendicular to the plane of ring channel 4 (plane of rotation of impeller 3), and partition 21 extends on the side of housing part 2 that faces away from the ring channel 4, approximately between outer edge 5 and inner edge 6. Inlet opening 8 and discharge opening 9, seen in the peripheral direction, directly adjoin this partition 21. Bypass channel 20 runs in this partition in a diagonal direction extending toward outer edge 5 of the ring channel 4 and thus encloses an angle with respect to the outer edge 5. Bypass channel 20 is open from about the height of the inlet opening 8 and extends in the form of an elongated, slot-shaped opening in partition 21. The angle enclosed by channel 20 with respect to the outer edge 5 of ring channel 4 at its center axis is an acute angle in a range of between 20° and about 45° and, according to a preferred embodiment, it is about 38°. In an extension of bypass channel 20, a threaded bore 22 is formed in housing 2 that is also inclined toward the outer edge 5 of ring channel 4. A setscrew 23 is threaded into this bore 22 and serves as a control element by which the free opening cross section of bypass channel 20 can be changed to regulate the output in a suitable way. Setscrew 23 is accessible from the peripheral outer side 24 of housing part 2. Thus, with a aid of a tool, such as a screwdriver, setscrew 23 can be twisted in a suitable way to adjust the desired free opening cross section of bypass channel 20.

Since, in the invention, bypass channel 20 is placed in proximity to the discharge opening 9 of ring channel blower 1 and the compressed air flow exiting at the discharge area of ring channel blower 1 has already become calmed and has become uniform with respect to its flow behavior, i.e., turbulence has been extensively reduced in the discharge area 9 by the above-described measures, a direct connection between discharge opening 9 and the inlet opening 8 via the bypass channel in this area produces an extremely quiet passing of air from the discharge to the inlet.

As apparent from the description above, by virtue of measures according to the invention, especially by the section 11 that covers the ring channel 4 in an upstream direction from discharge opening 9 that is opposite the compression direction, as well as by section 17 in the inlet area of ring channel blower 1, a significant reduction in noise emission of ring channel blower 1 is achieved during operation of about at least 25% in comparison to the noise emission of standard ring channel blowers of this general type of construction. Of course transitions 14, 15 to inner wall 6 and to outer wall 5 of ring channel 4, as well as the contouring of the inlet area and the discharge area of ring channel blower 1 that promote flow, contribute to this overall noise emission reduction. Further, it has been surprisingly shown that, with ring channel blower 1 according to the invention, despite a decrease in the active length of ring channel 4, no performance losses must be accepted. Rather, it has been shown that greater total pressure difference values are obtained at the same speed of ring channel blower 1 as compared to standard ring channel blowers, so that the operating level that is standard in and of itself is obtained with a far lower speed of ring channel blower 1 according to the invention as compared to standard ring channel blowers. Thus ring channel blower 1 according to the invention operates more effectively and consumes less energy, so that an energy-saving operation of ring channel blower 1 is simultaneously obtained, by virtue of the design according to the invention.

Figure 5:
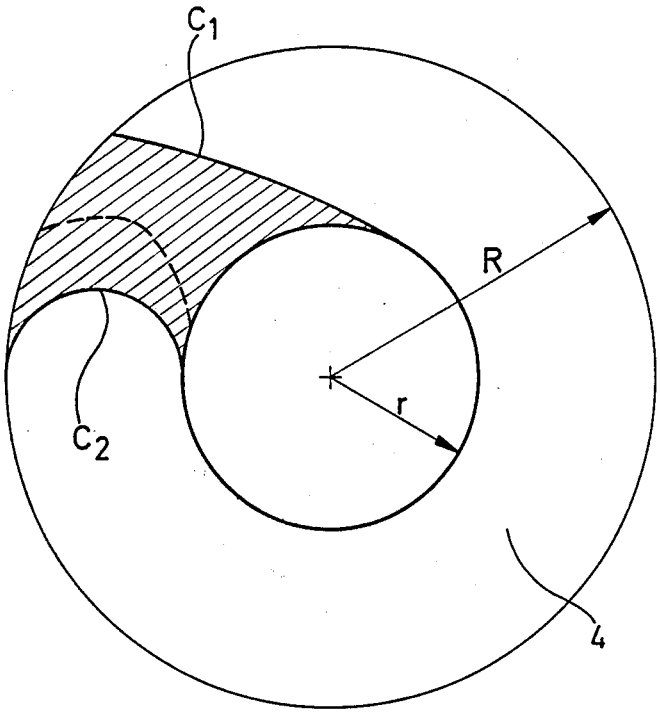
FIG. 5 is a diagrammatic view to clarify the course of the boundary edge of the upstream directed interrupter section covering the ring channel in the discharge area according to a preferred embodiment.

As can be seen from FIG. 5, the cross-hatched surface illustrates the area in which the curvature of boundary edge 12 of upstream directed interrupter section 11 covering the ring channel 4 lies, i.e., the above-mentioned range of modifications representing the set of curves for boundary edge 12. The curve designated by $C_1$ has a radius of 3R, while the curve designated by $C_2$ has a radius $R-r/2$, and they define the upper and lower curvature limits for edge 12, respectively. Naturally, boundary edge 12 is not required to have a uniform curvature, and combinations of at least two different curvatures from within the noted range can be used, but the edge configuration should be made so that there are no sharp edges (abrupt changes) at the transitions between sections of different curvatures that could rise to turbulence. An example of the use of two different curvatures is represented by a broken line in FIG. 5

Naturally the invention is not limited to the details represented in the figures of the drawing, but numerous changes and modifications are possible that one skilled in the art would find in case of need, also with respect to the dimensions and the performance requirements of such a ring channel blower 1, without leaving the spirit of the invention. Thus, the invention should not be viewed as limited to the disclosed embodiment, and, instead, encompasses the full scope of the claims appended hereto.

We claim:

1. Ring channel blower for combustion air conveyance in heaters, such as motor vehicle heaters, with a ring channel in a housing part that has an inlet opening and a discharge opening as well as a cross piece-shaped interrupter lying between them, with an impeller edged with vanes facing the ring channel and with a section of the interrupter, covering the ring channel and extending from the discharge opening in an upstream direction; wherein the ring channel covering section tapers from an inner edge of the ring channel in the area of discharge opening in an upstream direction to an outer edge of the ring channel.

2. Ring channel blower according to claim 1, wherein at least one of ends of the ring channel covering section, that merge with the inner edge a outer edge of the ring channel, respectively, is spiral-shaped.

3. Ring channel blower according to claim 1, wherein a downstream extending inlet section of the ring channel covering/section has a straight boundary edge that is substantially tangent to the inner edge of the ring channel.

4. Ring channel blower according to claim 1, wherein the ring/channel covering section is sickle-shaped and a tip of the sickle-shape ends at the outer edge of the ring channel and points in a direction opposite a compression direction.

5. Ring channel blower according to claim 4, wherein a section of the cross piece-shaped interrupter located in an inlet area, is inclined toward a bottom of the ring channel, is provided with a rounded end edge, and at least partially covers inlet opening.

6. Ring channel blower according to claim 4, wherein the ring channel covering section has a curved boundary edge which has a curvature with a radius within a range between about 3R and R r/2, where R represents the radius of curvature of the outer edge of the ring channel, and r represents the radius of curvature of the inner edge of the ring channel and $R-r/2$ represents half of the width of the ring channel.

7. Ring channel blower according to claim 1, wherein a section of the cross piece-shaped interrupter located in an inlet area, is inclined toward a bottom of the ring channel, is provided with a rounded end edge, and at least partially covers inlet opening.

8. Ring channel blower according to claim 1, wherein the ring channel covering section has curved boundary edge which has with a curvature with a radius within a range between about 3R and $R-r/2$, where R represents the radius of curvature of the outer edge of the ring channel, and r represents the radius of curvature of the inner edge of the ring channel and $R-r/2$ represents half of the width of the ring channel.

9. Ring channel blower according to claim 8, wherein said curved boundary edge is formed of a combination of at least two different curvatures within said range.

10. Ring channel blower according to claim 8, wherein a gradual transition, contoured to promote flow, extends from the inlet opening to a bottom of the ring channel over an area of at least 20% of the length of ring channel.

11. Ring channel blower according to claim 10, wherein a gradual transition, contoured to promote flow, extends from the ring channel to the discharge opening over an area of at least 20% of the length of the ring channel.

12. Ring channel blower according to claim 8, wherein a gradual transition, contoured to promote flow, extends from the ring channel to the discharge opening over an area of at least 20% of the length of the ring channel.

13. Ring channel blower according to claim 1, wherein a bypass channel is provided between the inlet opening and the discharge opening and has an open cross section that is adjustable by a setscrew, said bypass channel being provided in a partition that extends approximately perpendicular to a plane in which the ring channel plane is disposed and extends between the inner edge and the outer edge of the ring channel.

14. Ring channel blower according to claim 13, wherein said bypass channel is in the form of an elongated slot-shaped opening in said partition.

15. Ring channel blower according to claim 14, wherein said bypass channel is inclined toward the outer edge of the ring channel.

16. Ring channel blower according to claim 15, wherein the bypass channel encloses an acute angle relative to the outer edge of the ring channel.

17. Ring channel blower according to claim 16, wherein the acute angle is in a range of about 20° to 45°.

18. Ring channel blower according to claim 16, wherein said acute angle is 38°.

19. Ring channel blower according to claim 17, wherein the setscrew is inclined toward a peripheral outer wall of the housing part containing the ring channel, wherein the setscrew, to adjust the free opening cross section of bypass channel, is placed inclined relative to said outer wall of the housing part containing ring channel.

20. Ring channel blower according to claim 19, wherein the angle of inclination of the setscrew lies in a range of about 20° to 45°.

* * * * *